US007669261B2

(12) United States Patent
Früh et al.

(10) Patent No.: US 7,669,261 B2
(45) Date of Patent: Mar. 2, 2010

(54) APPARATUS FOR ADJUSTING THE BED OF AN OPERATING TABLE

(75) Inventors: Michael Früh, Achem (DE); Ulrich Wyslucha, Karlsruhe (DE)

(73) Assignee: Maquet GmbH & Co. KG, Rastatt (DE)

( * ) Notice: Subject to any disclaimer, the term of this patent is extended or adjusted under 35 U.S.C. 154(b) by 496 days.

(21) Appl. No.: 11/595,665

(22) Filed: Nov. 9, 2006

(65) Prior Publication Data

US 2007/0101500 A1 May 10, 2007

(30) Foreign Application Priority Data

Nov. 10, 2005 (DE) ..... 10 2005 053 754

(51) Int. Cl.
*A61G 13/08* (2006.01)

(52) U.S. Cl. ..... 5/616; 5/613

(58) Field of Classification Search ..... 5/613, 5/616

See application file for complete search history.

(56) References Cited

U.S. PATENT DOCUMENTS

| | | | |
|---|---|---|---|
| 566,521 | A | 8/1896 | Leger |
| 1,740,906 | A | 12/1929 | Rothauszky et al. |
| 2,416,410 | A | 2/1947 | Shampaine |
| 2,763,320 | A | 9/1956 | Schram |

(Continued)

FOREIGN PATENT DOCUMENTS

| | | |
|---|---|---|
| DE | 264297 | 8/1912 |

(Continued)

OTHER PUBLICATIONS

European Search Report for Serial No. EP 06 12 3443 dated Feb. 7, 2007.

(Continued)

*Primary Examiner*—Michael Trettel
(74) *Attorney, Agent, or Firm*—McCormick, Paulding & Huber LLP

(57) ABSTRACT

What is shown is an apparatus (10) for adjusting the bed (12) of an operating table, the said bed comprising a plurality of segments (14*a* to 14*f*) adjustable in relation to one another, at least some of the adjustable segments (14*a* to 14*f*) being connected to actuators (16*a* to 16*f*) which can be activated in order to adjust the associated segments (14*a* to 14*f*). The apparatus (10) comprises an input device (18) for the input of commands for the adjustment of at least some of the segments (14*a* to 14*f*) connected to actuators (16*a* to 16*f*). The apparatus (10) can be operated in at least two operating modes which correspond in each case to a specific position of a patient on the bed (12). The input device (18) has means for the input of body-part-related adjustment commands which are associated with the adjustment of the position of a body part or body portion of the patient. The apparatus (10) comprises means (22) for activating the actuators (16*a* to 16*f*, which are suitable for activating the actuators (16*a* to 16*f*) as a function of the current operating mode and of a body-part-related adjustment command, such that an adjustment of the position of a body part is brought about in accordance with the body-part-related adjustment command.

10 Claims, 2 Drawing Sheets

U.S. PATENT DOCUMENTS

| | | | | |
|---|---|---|---|---|
| 2,764,459 | A | 9/1956 | McDonald | |
| 2,771,330 | A | 11/1956 | Zaalberg | |
| 2,775,496 | A | 12/1956 | Berggren | |
| 2,816,806 | A | 12/1957 | Zaalberg | |
| 2,995,762 | A | 8/1961 | Albinson | |
| 3,226,734 | A | 1/1966 | Coventon | |
| 3,238,539 | A | 3/1966 | Koch | |
| 3,302,218 | A | 2/1967 | Stryker | |
| 3,328,079 | A | 6/1967 | Byczkowski et al. | |
| 3,362,704 | A | 1/1968 | Pilz | |
| 3,379,877 | A | 4/1968 | Makino et al. | |
| 3,388,700 | A | 6/1968 | Mountz | |
| 3,868,103 | A | 2/1975 | Pageot et al. | |
| 4,101,120 | A | 7/1978 | Seshima | |
| 4,176,415 | A | 12/1979 | Dickerson et al. | |
| 4,244,358 | A | 1/1981 | Pyers | |
| 4,597,119 | A | 7/1986 | Padgett | |
| 4,640,482 | A | 2/1987 | Rogers | |
| 5,031,547 | A | 7/1991 | Hirose | |
| 5,083,331 | A | 1/1992 | Schnelle et al. | |
| 5,220,698 | A | 6/1993 | Hannant | |
| 5,277,427 | A | 1/1994 | Bryan et al. | |
| 5,279,011 | A | 1/1994 | Schnelle | |
| 5,477,570 | A | 12/1995 | Hannant et al. | |
| 5,544,376 | A * | 8/1996 | Fromson | 5/618 |
| 5,564,852 | A | 10/1996 | Maxwell et al. | |
| 5,611,638 | A | 3/1997 | Dorr et al. | |
| 5,615,431 | A | 4/1997 | Vassilli | |
| 5,621,932 | A | 4/1997 | Strachan | |
| 5,649,833 | A | 7/1997 | Pfeuffer et al. | |
| 5,651,150 | A | 7/1997 | Kanitzer et al. | |
| 5,659,909 | A | 8/1997 | Pfeuffer et al. | |
| 5,754,997 | A * | 5/1998 | Lussi et al. | 5/618 |
| 5,769,720 | A | 6/1998 | Aiken et al. | |
| 5,787,528 | A * | 8/1998 | Antinori | 5/616 |
| 5,790,996 | A | 8/1998 | Narfstrom | |
| 5,914,796 | A | 6/1999 | Selin | |
| 5,969,488 | A * | 10/1999 | Fromson | 318/16 |
| 6,008,598 | A * | 12/1999 | Luff et al. | 318/16 |
| 6,073,284 | A | 6/2000 | Borders | |
| 6,095,713 | A | 8/2000 | Doyle et al. | |
| 6,351,678 | B1 * | 2/2002 | Borders | 700/83 |
| 6,390,927 | B1 | 5/2002 | Cleveland, III | |
| 6,396,224 | B1 * | 5/2002 | Luff et al. | 318/16 |
| 6,484,334 | B1 | 11/2002 | Borders et al. | |
| 6,560,492 | B2 | 5/2003 | Borders | |
| 6,565,156 | B1 | 5/2003 | Yamashita et al. | |
| 6,609,260 | B2 | 8/2003 | Hand et al. | |
| 6,619,872 | B2 | 9/2003 | Crorey et al. | |
| 6,634,202 | B1 | 10/2003 | Oetiker | |
| 6,722,289 | B2 | 4/2004 | Kato | |
| 6,862,761 | B2 | 3/2005 | Hand et al. | |
| 6,971,131 | B2 | 12/2005 | Bannister | |
| 6,986,179 | B2 | 1/2006 | Varadharajulu | |
| 7,010,369 | B2 | 3/2006 | Borders et al. | |
| 7,068,143 | B2 * | 6/2006 | Doering et al. | 340/3.1 |
| 7,089,612 | B2 * | 8/2006 | Rocher et al. | 5/613 |
| 7,154,397 | B2 | 12/2006 | Zerhusen et al. | |
| 7,181,791 | B2 | 2/2007 | Clayton | |
| 7,210,201 | B2 | 5/2007 | Maekle et al. | |
| 7,235,942 | B2 * | 6/2007 | Nagaoka et al. | 318/466 |
| 7,321,811 | B1 * | 1/2008 | Rawls-Meehan | 700/302 |
| 7,346,944 | B2 * | 3/2008 | Shaw | 5/616 |
| 7,367,740 | B2 | 5/2008 | Lazic et al. | |
| 7,398,790 | B2 | 7/2008 | Glatz | |
| 7,526,823 | B2 | 5/2009 | Koch | |
| 2002/0111701 | A1 | 8/2002 | Borders | |
| 2002/0170115 | A1 | 11/2002 | Borders et al. | |
| 2003/0078144 | A1 | 4/2003 | Gehrke | |
| 2003/0195644 | A1 | 10/2003 | Borders et al. | |
| 2004/0006821 | A1 | 1/2004 | Hand et al. | |
| 2004/0074003 | A1 | 4/2004 | Bannister | |
| 2004/0172757 | A1 | 9/2004 | Somasundaram | |
| 2007/0101497 | A1 | 5/2007 | Revenus | |
| 2007/0101500 | A1 * | 5/2007 | Fruh et al. | 5/613 |
| 2007/0107123 | A1 | 5/2007 | Koch | |
| 2007/0107124 | A1 | 5/2007 | Koch | |
| 2007/0107125 | A1 | 5/2007 | Koch | |
| 2007/0107126 | A1 | 5/2007 | Koch | |
| 2007/0107129 | A1 | 5/2007 | Burstner | |
| 2007/0110448 | A1 | 5/2007 | Ruch | |
| 2007/0116512 | A1 | 5/2007 | Katzenstein | |
| 2007/0118989 | A1 | 5/2007 | Koch | |
| 2009/0119842 | A1 | 5/2009 | Koch | |

FOREIGN PATENT DOCUMENTS

| | | | |
|---|---|---|---|
| DE | 4229318 | C1 | 9/1993 |
| DE | 296 10 726 | U1 | 9/1996 |
| DE | 19732467 | A1 | 2/1999 |
| DE | 197 51 320 | A1 | 5/1999 |
| DE | 19919496 | A1 | 11/2000 |
| DE | 102 53 878 | A1 | 5/2004 |
| DE | 102 53 906 | A1 | 6/2004 |
| EP | 0 457 246 | A1 | 11/1991 |
| EP | 0625348 | A1 | 11/1994 |
| EP | 0832603 | A1 | 4/1998 |
| EP | 0 913 139 | A | 5/1999 |
| FR | 2388546 | | 11/1978 |
| GB | 1 321 193 | | 6/1973 |
| GB | 2260075 | A | 4/1993 |
| GB | 2 277 870 | A | 11/1994 |
| WO | 99 28146 | A1 | 6/1999 |
| WO | 02 055001 | A1 | 7/2002 |
| WO | 03 086263 | A1 | 10/2003 |

OTHER PUBLICATIONS

European Search Report for Serial No. EP 06 12 3598 dated Feb. 8, 2007.

European Search Report for Serial No. EP 06 12 3596 dated Sep. 7, 2007.

European Search Report for Serial No. EP 06 12 3592 dated Nov. 29, 2007.

European Search Report for Serial No. EP 06 12 3593 dated Dec. 4, 2007.

European Search Report for Application No. EP 06 12 3721, dated Jun. 20, 2008.

European Search Report for Application No. EP 06 12 3444, dated Aug. 22, 2008.

European Search Report for Application No. EP 06 12 3719, dated Sep. 7, 2007.

V. Vitsas, et al., Performance Analysis of the Advanced Infrared (AIr) CSMA/CA MAC Protocol for Wireless LANs, Kluwer Academic Publishers, Wireless Networks 9, pp. 495-507.

* cited by examiner

APPARATUS FOR ADJUSTING THE BED OF AN OPERATING TABLE

CROSS REFERENCE TO RELATED APPLICATIONS:

Applicant hereby claims foreign priority benefits under U.S.C. § 119 from German Patent Application No. 10 2005 053 754.5 filed on Nov. 10, 2005, the contents of which are incorporated by reference herein.

FIELD OF THE INVENTION

The present invention relates to an apparatus for adjusting the bed of an operating table, the said bed comprising a plurality of segments adjustable in relation to one another, at least some of the adjustable segments being provided with actuators which can be activated in order to adjust the associated segments, and comprising an input device for the input of commands for the adjustment of at least some of the segments provided with actuators.

BACKGROUND OF THE INVENTION

In known apparatuses of this type, the input device is conventionally formed by an operating instrument with an operating face, on which buttons for adjusting the various segments are arranged. For this purpose, typically, in addition to the buttons for adjusting the individual segments, pictographs of the bed are depicted in a side view, the respective segment being emphasized in colour in these pictographs. By means of the pictographs, the user recognizes the button provided for adjusting a specific segment.

When a patient is supported on the bed in the usual way, that is to say in what is known as a normal position, each of the segments of the bed matches with a specific body part or body portion. For example, the bed may comprise a back segment, as a result of the adjustment of which the back is raised or lowered in the patient's normal position, etc.

In practice, however, the situation arises where patients are supported on the bed differently from the normal position. An important instance is a support which deviates from the normal position and in which the patient is displaced in the direction of the head end or foot end in relation to the normal position. There may be various reasons for such a support which deviates from the normal position. For example, it may be necessary, for a special intervention, that additional medical instruments, for example an operating microscope, have to be brought into the vicinity of a body part to be treated, and that this cannot be done for reasons of space when the patient is supported in the normal position. Another reason may be that a specific body part is to be radiographed, lying on the operating table, and that this is not possible in the normal position. However, supports deviating from the normal position may also become necessary due to specific operating techniques, novel interventions, anatomical features or a surgeon's preference.

A further example of a support deviating from the normal position is what is known as "reverse support", in which the patient is rotated through 180° in relation to the normal position such that the head and foot end are interchanged. Even a reverse support of this kind may be necessary for reasons of space. However, it is also used relatively frequently, for example, in neurological operations in the head region.

When the patient is supported on the bed in a position other than the normal position, the following problem arises: since, in the position deviating from the normal position, the patient's body parts lie at least partially on other segments of the bed than in the normal position, as a rule, to adjust a specific body part, other segments of the bed have to be adjusted than those in the normal position. The user must therefore always consider which of the segments has to be adjusted, in the present position of the patient on the bed, in order to vary the position of a specific body part. This "rethink" between the various positions of the patient on the bed places an additional burden on the user, that is to say the surgeon or the theatre sister, and errors may occur during adjustment.

The correct adjustment of the bed may, in practice, be made even more difficult when the view of the bed is disguised by cover sheets or appliances, so that the user cannot see which segment has to be adjusted in order to vary the position of a body part. A further difficulty is that the beds of modern operating tables are often asymmetric, so that the illustrations of the pictographs identifying the buttons of the operating instrument correctly reproduce only the view from one side, but not the view from the other side. If the user stays on this other side of the operating table, this additionally complicates the choice of the correct button.

SUMMARY OF THE INVENTION

The object on which the invention is based is to specify an apparatus of the type mentioned in the introduction, in which the adjustment of the position of individual body parts is simplified in spite of different positions of the patient on the bed.

In the apparatus of the type mentioned in the introduction, this object is achieved in that it can be operated in at least two operating modes which correspond in each case to a specific position of a patient on the bed, and in that the input device has means for the input of body-part-related adjustment commands which are associated with the adjustment of the position of a body part or body portion of the patient, and in that the apparatus comprises means for activating the actuators, which are suitable for activating the actuators as a function of the current operating mode and of a body-part-related adjustment command, such that an adjustment of one or more segments is brought about in accordance with the body-part-related adjustment command.

In the apparatus according to the invention, therefore, the adjustment commands are abstracted from the segments and, instead, related to the body part, that is to say directed at the adjustment of the position of a body part or body portion of the patient. The apparatus then itself, taking into account the current operating mode which, in turn, corresponds to the position of the patient on the bed, determines which of the segments have to be adjusted in order to implement the body-part-related adjustment command. In simplified terms, the apparatus takes over from the user the "rethink" which the various possible positions conventionally make necessary. As a result, he is relieved, and errors can be avoided.

Preferably, the apparatus has an electronic control unit which comprises at least one input for body-related adjustment commands and which is programmed such that, from a body-related adjustment command received via the at least one input and from information relating to the current operating mode, it generates control signals for the actuators which bring about an adjustment of one or more segments in accordance with the body-part-related adjustment command.

In an advantageous development, the apparatus comprises a store, in which various positions of the bed can be stored, and means for selecting one of the various stored positions and for activating the actuators in accordance with the selected position. Proven and more frequently required settings of the bed can thus be stored in the store and produced quickly at any time. Time and effort in the operation can consequently be saved. Moreover, preset suitable positions of the operating table can be stored even ex-factory in this store.

Furthermore, the apparatus may comprise means for storing a present position of the bed in a store and means for retrieving such a stored position and for activating the actuators in accordance with the retrieved position. By these means, a "short-time storage function" is implemented, in which a current position of the bed can be stored, so that, after an intermediate adjustment, said current position can easily be recovered. This is necessary, for example, when, in a certain position of the bed, a surgical intervention is interrupted in order to radiograph the patient, during which the bed has to be set level, and then the bed is to be adjusted back into the original position.

Preferably, the input device is formed by an operating instrument with an operating face, and at least part of the means for the input of body-part-related adjustment commands and/or of the means for the input of the non-body-part-related adjustment commands and/or of the means for the input of the operating mode are formed by buttons or keys which are arranged on the operating face. In this case, preferably, a human body is depicted on the operating face, and the buttons or keys for the input of body-part-related adjustment commands are arranged in the vicinity of the corresponding body part of the image. It is thus easy to find the appropriate button for each desired body-related adjustment command when the image of the human body is used as a guide.

BRIEF DESCRIPTION OF THE DRAWINGS

For a clearer understanding of the present invention, reference is made to the preferred exemplary embodiment which is illustrated in the drawings and which is described by means of specific terminology. It may be pointed out, however, that the scope of protection of the invention is not to be restricted thereby, since such variations and further modifications to the apparatus shown and such further applications of the invention as are indicated in it are considered as customary current and future specialized knowledge of a competent person skilled in the art. An exemplary embodiment of the invention is shown in the figures in which, to be precise.

DETAILED DESCRIPTION OF THE INVENTION

Figure 1:
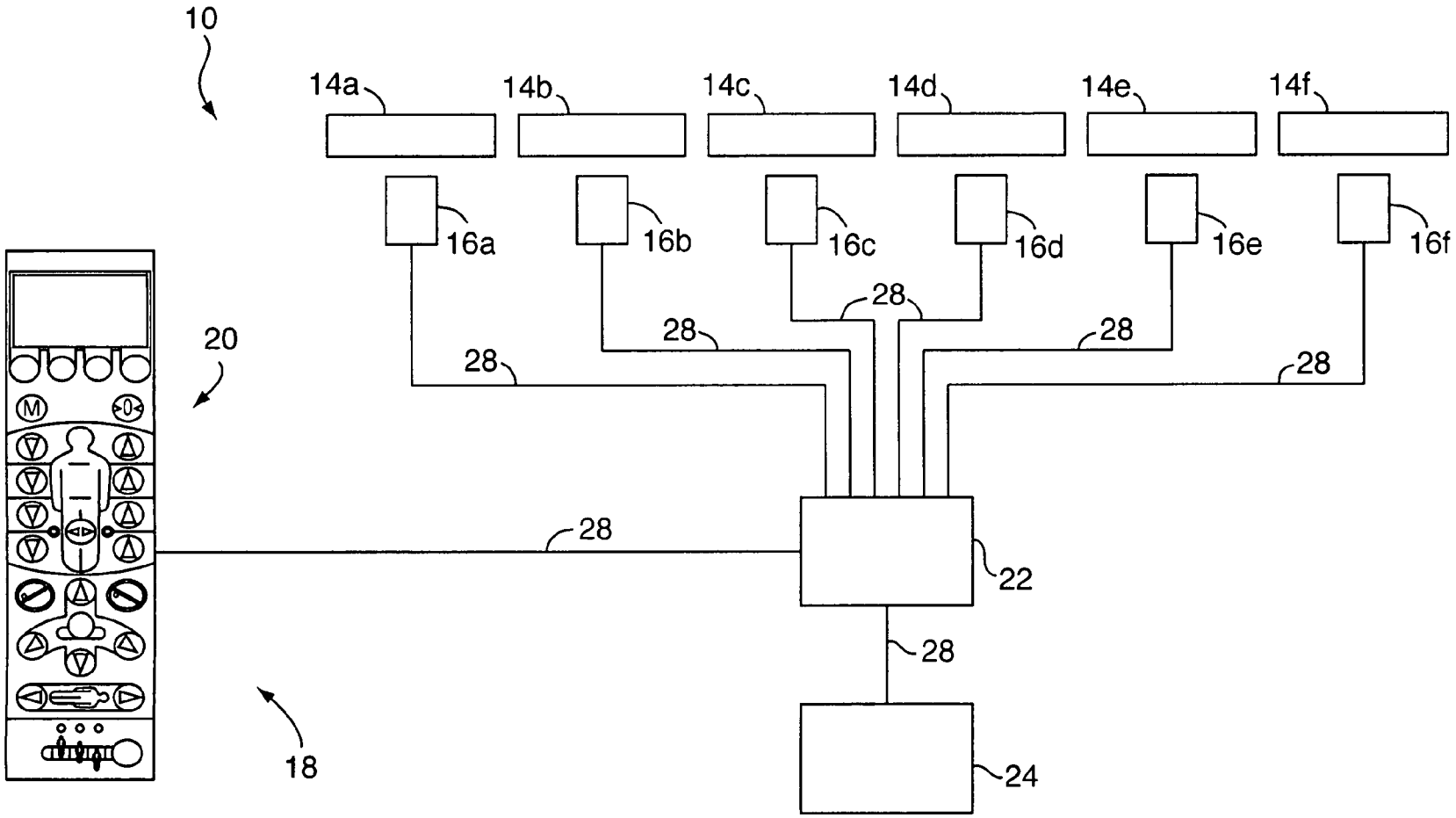
FIG. 1 shows a block diagram of an apparatus for adjusting the bed of an operating table.

FIG. 1 illustrates diagrammatically an apparatus 10 for adjusting a bed 12 of an operating table as a block diagram. The bed 12 of the exemplary embodiment of FIG. 1 is formed from six segments 14*a* to 14*f* which are adjustable in relation to one another by means of associated actuators 16*a* to 16*f*. By the segments 14*a* to 14*f* being adjusted, the bed 12 can be adjusted into different positions both before and during the operation.

Figure 2:
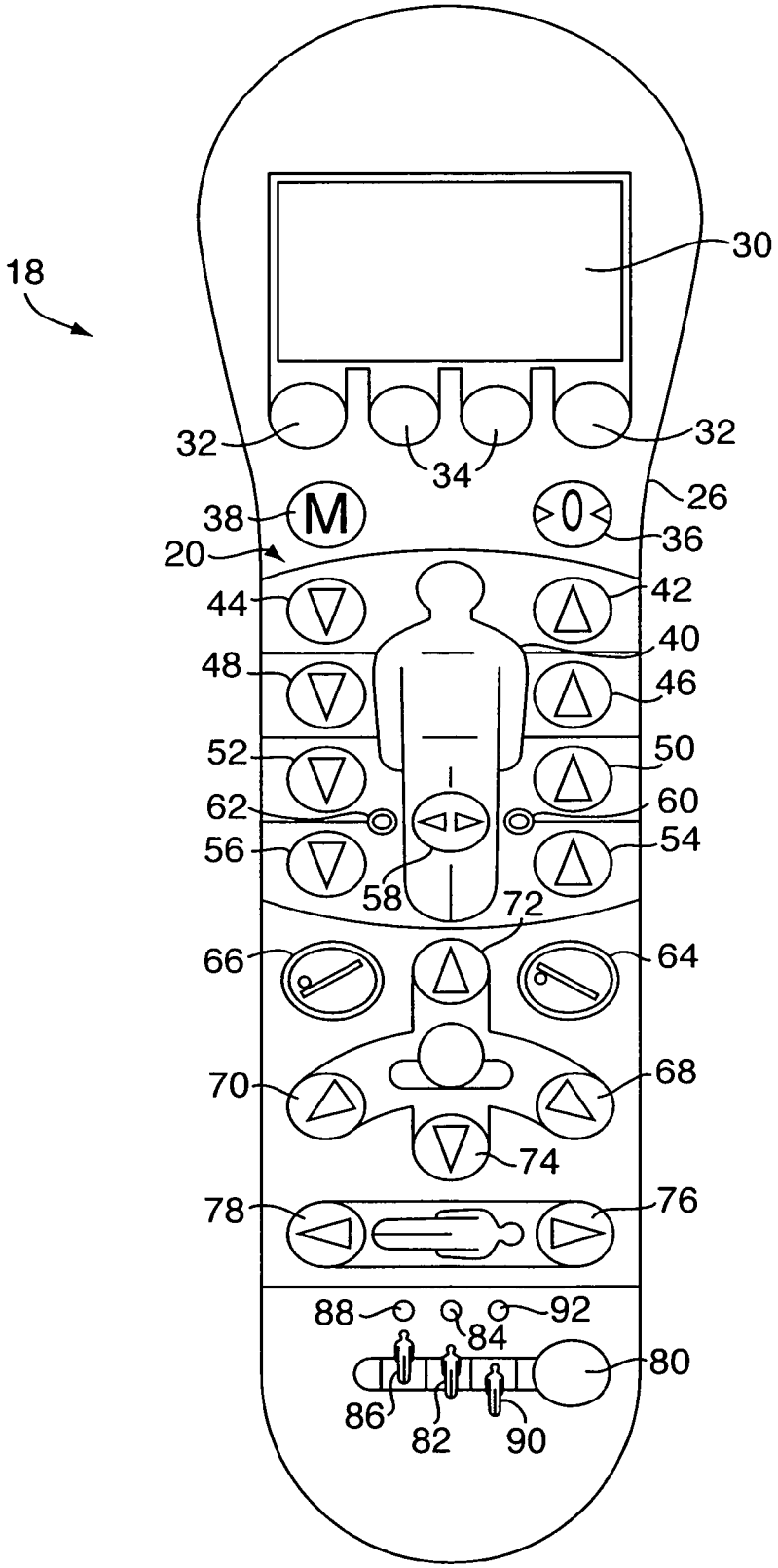
FIG. 2 shows a top view of an operating instrument of the apparatus of FIG. 1.

The apparatus 10 comprises an operating instrument 18 with an operating face 20, an electronic control unit 22 and a store 24. In the block diagram of FIG. 1, which serves primarily for explaining the functioning of the apparatus 10, the operating face 20, the electronic control unit 22 and the store 24 are illustrated, spatially separate. In actual fact, however, in the exemplary embodiment shown, the electronic control unit 22 and the store 24 are located in a housing 26 of the operating instrument 18 which is illustrated in a top view in FIG. 2. As can be seen in FIG. 2, the operating face 20 is formed on the top side of the operating instrument 18. The operating instrument 18 is portable and is dimensioned in size and shape such that it can be held in one hand and in this case be operated with the thumb of the same hand.

As can be seen in FIG. 1, the electronic control unit 22 is connected to the operating face 20, the store 24 and the actuators 16*a* to 16*f* via signal lines 28. However, the operating instrument 18 may also be of wireless design and transmit the control commands, for example via an IR interface, to a control unit in the column of the operating table. The signal lines 28 may be formed by a system bus.

The operating face 20 of the operating instrument 18 is described in more detail below with reference to FIG. 2. In this case, the elements of the operating face 20 in the illustration of FIG. 2 are described in succession from the top downwards.

An LCD display 30 is located at the very top on the operating face 20. Directly below this are arranged two soft keys 32 and two scroll keys 34. By means of the soft keys 32 and the scroll keys 34, the program functions of the operating instrument 18 can be actuated interactively. The functions provided in the apparatus 10 are offered in the form of a menu, as it is known, on the display 30 and are selected with the aid of the scroll keys 34.

What follow next are a switch 36, by the actuation of which the bed 12 is set into the level horizontal position, and a short-time store key 38, the function of which is described in more detail below.

A diagrammatic image 40 of a human body is located in a middle portion of the operating face 20. On the left and right of this image 40 are located buttons for the input of body-related adjustment commands. Body-related adjustment commands are those commands which are directed at the adjustment of the position of a body part or body portion of the patient who is supported on the bed 12 of the operating table. Body-part-related adjustment commands differ in this from adjustment commands which will be directed at adjusting a specific segment 14*a* to 14*f*.

In concrete terms, the said buttons for the input of body-related adjustment commands comprise the buttons 42 and 44 for raising and lowering the upper back, the buttons 46 and 48 for raising and lowering the lower back (and, consequently, the complete upper body, since the segment of the upper back is articulated on the segment of the lower back), the buttons 50 and 52 for raising and lowering the thighs (and, consequently, the entire legs) and the buttons 54 and 56 for raising and lowering the lower legs of the patient.

Normally, both thighs and both lower legs are adjusted simultaneously by the actuation of the buttons 50 to 56. By a selection button 58 being pressed, however, a single leg can be selected, which is then adjusted by the actuation of the buttons 50 to 56. If the left leg of the patient is selected, this is indicated by the illumination of an LED 60. In this state, the left thigh or the left lower leg is adjusted by the actuation of one of the buttons 50 to 56. Pressing the selection button 58 changes over to the right leg, this being indicated by the extinguishing of the LED 60 and the illumination of an LED 62. In this case, the position of the right thigh or right lower leg is brought about by the actuation of the buttons 50 to 56. By selection button 58 being pressed once again, both LEDs 60 and 62 light up, and the legs are again adjusted together.

As becomes clear from the above description, on the operating face 20, the buttons 42 to 56 for the input of body-related adjustment commands are arranged in the vicinity of the corresponding body part of the image 40 of the human body. It is thus easy to find the appropriate button for each desired body-related adjustment command when the image 40 of a human body is used as a guide.

Buttons for the input of non-body-part-related adjustment commands are located on the lower half of the operating face 20. In this embodiment, the non-body-part-related adjustment commands are those adjustment commands which relate to an adjustment of the entire bed. In concrete terms, the operating face 20 comprises the following buttons for non-body-part-related adjustment commands: buttons 64 and 66 for changing the inclination of the bed 12 in the longitudinal direction, in such a way that the head end is raised or lowered, buttons 68 and 70 for changing the inclination of the bed 12 in such a way that the right or the left body side of the patient supported on it is lowered, buttons 72 and 74 for raising and lowering the bed 12 as a whole, and buttons 76 and 78 for the translation of the bed 12 in its longitudinal direction in the direction of the head end or foot end.

Finally, a button 80 for selecting one of three operating modes in which the apparatus 10 can be operated is located at the lower end of the operating face 20. In this case, each of the operating modes corresponds to a specific position of the patient on the bed 12. The first operating mode corresponds to a middle or normal position of the patient on the bed 12, and this position is symbolized by the pictograph 82 on the operating face 20. When the first operating mode is selected, an LED 84 lights up, which is arranged above the pictograph 82.

A second operating mode corresponds to a position in which the patient is displaced in relation to the normal position in the longitudinal direction of the bed 12 in the direction of the head end. This position of the second operating mode is symbolized by the pictograph 86. When this second operating mode is selected, an associated LED 88 lights up. The third operating mode corresponds to a position in which the patient is displaced in relation to the normal position in the longitudinal direction of the bed 12 in the direction of the foot end. This position of the third operating mode is symbolized by the pictograph 90, and an LED 92 lights up when this third operating mode is selected.

The functioning of the apparatus 10 is explained below. As was described above, the three different operating modes correspond to different positions of a patient on the bed 12. Different operations may require different positions of the patient on the bed or at least make them advantageous. For example, for reasons of space, it may be advantageous for many interventions to displace the patient in relation to a normal position in the direction of the foot end or head end of the bed. Thus, whilst, for example in the illustration of FIG. 1, in a first position (normal position) the thigh of a patient would lie on the segment 14*b*, in a second position (corresponding to the second operating mode), in which the patient is displaced in the direction of the head end, the lower leg could lie on the segment 14*b*, while the thigh would lie at least partially on the segment 14*c*. In a third position, in which the body is displaced in relation to the first position in the direction of the foot end, by contrast, the thigh could lie on the segment 14*a* and the pelvis on the segment 14*b*.

The result of this is that, to adjust the same body part in the three different positions of the patient, in each case another of the segments 14*b* to 14*f* has to be adjusted. Where the conventional operating instrument is concerned, in which the buttons for the input of adjustment commands are always associated with one of the adjustable segments, the user must rethink, depending on the position of the patient, in order even to press the correct button so as to adjust the desired body part.

By contrast, this difficulty does not arise in the apparatus 10 according to an embodiment of the invention. Instead, the buttons 42 to 58 are not related to a certain segment 14*a* to 14*f*, but to a body part or a body portion. If the patient is supported on the bed 12 in one of the three predetermined positions to which the three operating modes correspond, the correct operating mode has to be selected only at the start by the actuation of the button 80. When one of the buttons 42 to 56 for body-part-related adjustment commands is pressed, the electronic control unit 22, from the body-related adjustment command received and from the information relating to the current operating mode, provides the suitable control signals for the actuators 16*a* to 16*f*, that is to say the control signals which, in the present position of the patient on the bed 12 (that is to say, the first, second or third position), bring about an adjustment of the position of a body part in accordance with the body-part-related adjustment command. The user therefore no longer has to rethink between the various positions, but, instead, the respective position of the patient on the bed 12 is taken into account automatically by the electronic control unit. To that extent, the operation of the operating instrument 18 is abstracted from the actual position of the patient on the bed 12, with the result that operation is appreciably simplified and errors can be avoided.

In an alternative embodiment, a distinction can additionally be made, as regards the orientation of the patient's head on the bed 12, between the normal position and the "reverse position", described in the introduction, in which the head end and the foot end are interchanged with respect to the normal position. The reverse position can be input via the soft keys 32 and/or the scroll keys 34. In this alternative embodiment, the apparatus 10 can be operated in six different modes which correspond to the possible combinations of the three displacement modes and of the two orientations of the head. It should be noted that, in this alternative embodiment, the buttons 64 and 66 for changing the inclination of the bed 12 in the longitudinal direction, the buttons 68 and 70 for changing the inclination of the bed 12 in the transverse direction and the buttons 76 and 78 for a translation of the bed 12 in its longitudinal direction are likewise buttons for the input of body-part-related adjustment commands.

Various positions of the bed 12 can be stored in the store 24. By the scroll keys 34 being actuated, these stored positions can be selected from a menu illustrated on the display 30. As a result, proven or more frequently required settings of the bed 12 which are stored in the store 24 can be produced at any time. Instead of the store 24, however, a store may also be provided in the column of the operating table.

Furthermore, by the short-time storage key 38 being pressed, the current position of the bed 12 can be stored. This is advantageous, for example, when the bed 12 is briefly set level in an operation by the actuation of the key 36, in order to radiograph the patient, and is then to be adjusted back into the previous position again. By the scroll keys 34 and/or the soft keys 32 being actuated, the bed 12 can then be adjusted quickly back into the position stored with the aid of the short-time storage key 38.

Although a preferred exemplary embodiment is shown and described in detail in the drawings and in the above description, this should be considered as purely illustrative and not restrictive of the invention. It is pointed out that only the preferred exemplary embodiment is illustrated and described, and all variations and modifications which come at the present time and in future within the scope of protection of the invention are to be protected.

While the present invention has been illustrated and described with respect to a particular embodiment thereof, it should be appreciated by those of ordinary skill in the art that various modifications to this invention may be made without departing from the spirit and scope of the present invention.

What is claimed is:

1. An apparatus for adjusting the bed of an operating table, the said bed comprising a plurality of segments adjustable in relation to one another, at least some of the adjustable segments being provided with actuators which can be activated in order to adjust the associated segments, with an input device for the input of commands for the adjustment of at least some of the segments provided with actuators, wherein the apparatus can be operated in at least two operating modes which correspond in each case to a specific position of a patient on the bed, wherein the input device has a plurality of buttons for the input of body-part-related adjustment commands which are associated with the adjustment of the position of a body part or body portion of the patient, and one or more buttons for selecting one of a plurality of operating modes, wherein the apparatus comprises an electronic control unit for activating the actuators, which provides suitable control signals for activating the actuators as a function of the current operating mode and of a body-part-related adjustment command, such that an adjustment of one or more segments is brought about in accordance with the body-part-related adjustment command, and wherein the plurality of operating modes correspond to a plurality of positions of the patient on the bed which differ from one another by displacement of the patient along the bed.

2. The apparatus according to claim 1, in which the adjustments associated with the body-part-related adjustment commands comprise the raising and lowering of one or more of the following body parts: the upper back, the lower back, the left thigh, the right thigh, both thighs in synchronism, the left lower leg, the right lower leg and both lower legs in synchronism.

3. The apparatus according to claim 1, in which positions of the patient on the bed to which the operating modes correspond differ from one another in an interchange of the head end and foot end.

4. The apparatus according to claim 1, in which the input device comprises one or more buttons for the input of non-body-part-related adjustment commands which relate to one or more of the following adjustments of the entire bed: the raising and lowering of the bed, the change in the inclination of the bed in its longitudinal direction, the change in the inclination of the bed in its transverse direction, and the translation of the bed in its longitudinal direction.

5. The apparatus according to claim 1, with a store, in which various positions of the bed can be stored, and with means for selecting one of the various stored positions and for activating the actuators in accordance with the selected position.

6. The apparatus according to claim 1, with means for storing a present position of the bed in a store and with means for retrieving such a stored position and for activating the actuators in accordance with the retrieved position.

7. The apparatus according to claim 1, in which the input device is formed by an operating instrument with an operating face, and at least some of the buttons for the input of body-part-related adjustment commands and/or of the buttons for the input of the non-body-part-related adjustment commands and/or of the buttons for the input of the operating mode are arranged on the operating face.

8. The apparatus according to claim 7, in which a human body is depicted on the operating face, and the buttons for the input of body-part-related adjustment commands are arranged in the vicinity of the corresponding body part of the image.

9. The apparatus according to claim 7, in which a display, is provided on the operating face.

10. The apparatus according to claim 7, in which the operating instrument is portable and is dimensioned in size and shape such that it can be held in the hand.

* * * * *

UNITED STATES PATENT AND TRADEMARK OFFICE

CERTIFICATE OF CORRECTION

PATENT NO. : 7,669,261 B2
APPLICATION NO. : 11/595665
DATED : March 2, 2010
INVENTOR(S) : Früh et al.

It is certified that error appears in the above-identified patent and that said Letters Patent is hereby corrected as shown below:

In the Abstract:
Line 16, after "16*f*" please insert --)--.

In the Claims:
Column 8, line 34, after "display" please delete ",".

Signed and Sealed this

Twenty-seventh Day of July, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,669,261 B2
APPLICATION NO. : 11/595665
DATED : March 2, 2010
INVENTOR(S) : Früh et al.

It is certified that error appears in the above-identified patent and that said Letters Patent is hereby corrected as shown below:

Title Page, Item (57) Abstract:
Line 16, after "16*f*" please insert --)--.

In the Claims:
Column 8, line 34, after "display" please delete ",".

This certificate supersedes the Certificate of Correction issued July 27, 2010.

Signed and Sealed this

Twenty-fourth Day of August, 2010

David J. Kappos

David J. Kappos
*Director of the United States Patent and Trademark Office*